US007604061B2

(12) United States Patent
Fay et al.

(10) Patent No.: US 7,604,061 B2
(45) Date of Patent: Oct. 20, 2009

(54) COUPLER RETAINED LINER HANGER MECHANISM AND METHODS OF SETTING A HANGER INSIDE A WELLBORE

(75) Inventors: Peter J. Fay, Houston, TX (US); Gerald D. Lynde, Houston, TX (US); Edward J. O'Malley, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 12/380,206

(22) Filed: Feb. 24, 2009

(65) Prior Publication Data

US 2009/0159268 A1 Jun. 25, 2009

Related U.S. Application Data

(62) Division of application No. 11/725,343, filed on Mar. 19, 2007, now Pat. No. 7,537,060.

(51) Int. Cl.
*E21B 23/00* (2006.01)
*E21B 23/02* (2006.01)
*E21B 43/10* (2006.01)

(52) U.S. Cl. ..... 166/382; 166/216; 166/217; 166/208

(58) Field of Classification Search ..... 166/382, 166/216, 217, 208; 285/123.4, 123.5, 123.11
See application file for complete search history.

(56) References Cited

U.S. PATENT DOCUMENTS 5,255,746 A * 10/1993 Bridges ..... 166/348
6,138,751 A * 10/2000 Hart ..... 166/75.14

* cited by examiner

*Primary Examiner*—Jennifer H Gay
*Assistant Examiner*—Cathleen R Hutchins
(74) *Attorney, Agent, or Firm*—Greenberg Traurig LLP; Anthony F. Matheny

(57) ABSTRACT

A liner hanger has a housing with a pocket disposed on an inner wall surface and a slip slidingly engaged within the pocket. The liner hanger housing is secured in the string of casing. A setting mechanism connected to the slips is also located in the pocket. An actuator is mounted on the liner. As the liner is moved through the casing coupler, the actuator actuates the setting mechanism, causing the slips to move axially downward. As the setting mechanism moves downward, the slips move radially inward and grip the liner.

15 Claims, 9 Drawing Sheets

COUPLER RETAINED LINER HANGER MECHANISM AND METHODS OF SETTING A HANGER INSIDE A WELLBORE

RELATED APPLICATION

This application is a divisional application of, and claims priority to, U.S. patent application Ser. No. 11/725,343 filed Mar. 19, 2007, now U.S. Pat. No. 7,537,060.

BACKGROUND

1. Field of Invention

The invention is directed to couplers or collars having one or more axially movable slips disposed therein for connecting oil and gas well casing and for hanging a liner within the casing.

2. Description of Art

A liner is a tubular member that is usually run inside of wellbore casing of an oil or gas well and suspended within the wellbore casing. Liners are typically secured within a wellbore by toothed slips that are located on liner hangers. The slips are set by axially translating them with respect to the liner hanger mandrel or housing. As the slips are translated axially, they are cammed radially outward by a ramped surface that is fashioned into the mandrel. As the slips move radially outward, the toothed surfaces of the slip will bitingly engage the inner wall surface of the wellbore casing. This type of arrangement is shown, for example, in U.S. Pat. No. 4,497,368 in which slips are radially expanded by riding up over cone elements disposed into the tubular body of the central mandrel.

Actuation systems for such slips in the past employed full circumference hydraulically actuated pistons to move the slips. These designs presented a pressure rating problem in that the full circumference piston frequently had a maximum working pressure significantly lower than the mandrel which it surrounded. Thus, this type of design limited the maximum working pressure in the string to the rating of the cylindrical piston housing assembly. For example, it was not unusual in prior designs to have mandrels rated for 12,000 PSI while the surrounding cylinder housing for the cylindrical piston to only have a rating of approximately 3,000 PSI.

In an effort to improve the shortcoming of this design, another design illustrated in U.S. Pat. No. 5,417,288 was developed. In this design the mandrel body received a pair of bores straddling each of the slips. A piston assembly was mounted in each of the bores with all of the necessary seals. The application of hydraulic pressure in the mandrel into all the piston bores actuated the pistons on either side of each slip through a common sleeve to which all the slips were attached. This design, however, was expensive to manufacture, had many potential leak paths in the form of the ring seals on each of the pistons wherein each slip required two pistons.

On the other hand, this design provided for a higher pressure rating for the liner hanger body and also used the hydraulic pressure directly to actuate the slips. Necessarily, it did not include a locking feature against premature slip movements due to inadvertently applied pressures. The design in U.S. Pat. No. 5,417,288 also did not provide for flexibility for changed conditions downhole which could require additional force to set the slips. In essence, each application was designed for a pre-existing set of conditions with field variability not included as a feature of that prior art design.

These prior liner hangers also required use of devices and structures that increase the overall outer diameter of the liner hanger. Therefore, these liner hangers result in a reduction of usable diameter within the well. This is because the liner hanger is carried by the liner which requires the liner to be of a smaller diameter than the casing against which it is set or hung. The liner is then set within the annular space between the liner and the casing. Once set, the useable diameter of the well (i.e., the diameter through which production fluid can flow or tools can be passed) becomes the inner diameter of the liner. However, the components of the device securing the liner within the casing (including slips, elastomeric seals, setting sleeves and so forth) inherently occupy space between the liner and casing. For example, a wellbore having standard 21.40 lb. casing with an outer diameter of 5 inches, would have an inner diameter of 4.126 inches. It would be desirable to run into the casing a string of tubing, i.e., a liner, having an outer diameter of approximately 4 inches, which would allow for a liner with a large cross-section area for fluid flow and tool passage. However, the presence of the liner setting components on the outside of the liner will dictate that a smaller size liner or tubing string (such as 2⅞ inches) be run. Over an inch of diameter in usable area is lost due to the presence of both the liner and the liner setting device that is set within the space between the liner and the casing.

With respect to the slip assemblies, in the past those slip assemblies also have been configured in a variety of ways. In one configuration, when the slips are actuated, the load is passed through the slips circumferentially through their guides or retainers and transmission of the load to the underlying mandrel is avoided. In other more traditional designs, the slips are driven along tapered surfaces of a supporting cone and the loading that is placed on the supporting mandrel is in a radial direction toward its center, thus tending to deform the mandrel when setting the slips. Typical of such applications are U.S. Pat. Nos. 4,762,177, 4,711,326 and 5,086,845.

In another prior attempt, illustrated in U.S. Pat. No. 6,431,277, the liner hanger has an actuating piston that releases a mechanical latch that is restraining a set of springs. Once the latch is released, the springs set the slips. The liner hanger in this patent is also designed with a separate spring housing that restricts the total number of springs that can be used and is difficult to assemble. All of these prior slip assemblies are complex and, thus, expensive to manufacture.

Accordingly, prior to the development of the present invention, there has been no casing coupler or method of setting a liner hanger within a wellbore that: provides an easy to assemble liner hanger; provides a simple process for hanging the liner; provides an easily adaptable liner hanger for receiving different size and weight liners; and provides setting of a liner hanger inside a wellbore with little appreciable reduction in the useable area of the wellbore. Therefore, the art has sought a casing coupler and a method of setting a liner hanger within a wellbore that: provides an easy to assemble liner hanger; provides a simple process for hanging the liner; provides an easily adaptable liner hanger for receiving different size and weight liners; and provides setting of a liner hanger inside a wellbore with little appreciable reduction in the useable area of the wellbore.

SUMMARY OF INVENTION

Liner hanger mechanisms disclosed herein are directed to a coupler or collar for joining two pieces of oil or gas well casing. The coupler includes an enlarged inner diameter portion forming a pocket in the inner wall surface of the coupler. Slidingly engaged within the pocket is a slip. The slip includes a first end having a setting mechanism and a second end having a gripping member.

In use, the coupler secures together two pieces of casing. The casing is then run into the wellbore to the desired depth. Although not required, the casing can then be cemented into place.

An inner tubing, or liner, such as production casing is then run into the casing. The liner includes a setting element that engages with the setting mechanism of the slip. As the liner continues to be lowered within the casing, the setting element engages the setting mechanism, causing the slip to slide downward and, thus, causing the gripping member to engage the liner and secure the liner within the casing.

Because the setting mechanism is located within the pocket portion of the casing coupler, the liner can be set or hung within the casing while saving useable cross-sectional area within the casing. In the instance of the 5 inch casing situation described above in the Background section, a liner having a four inch diameter could be run into the exterior casing.

The casing couplers and methods of setting a liner hanger within a wellbore have the advantages of: providing an easy to assemble and disassemble liner hanger; providing a simple process for hanging the liner; providing an easily adaptable liner hanger for receiving different size and weight liners; and providing setting of a liner hanger inside a wellbore with little appreciable reduction in the useable area of the wellbore.

In one aspect of the disclosure, one or more of the foregoing advantages may be achieved through a liner hanger for hanging a liner within a bore of a casing string. The liner hanger may comprise a housing for securing into the casing string at a desired location, the housing having a housing bore, an outer wall surface, and an inner wall surface, the inner wall surface having a pocket disposed thereon; a slip disposed within the pocket, the slip having a gripping inner wall surface; a setting mechanism mounted to the slip, the slip being movable from an upper position fully recessed within the pocket to a lower position wherein the gripping inner surface protrudes inward from the pocket; and an actuator for connection to a liner for placement within the housing bore, the actuator when in the housing bore, causing the slip to move downward and inward to engage and secure the liner within the bore.

A further feature of the liner hanger is that the setting mechanism may comprise at least one recess and the actuator comprises at least one key that enters the recess so that downward movement of the actuator moves the slip downward. Another feature of the liner hanger is that the actuator may bias the key outward. An additional feature of the liner hanger is that the setting mechanism may comprise a helical thread disposed on an outer wall surface, the helical thread being matingly engaged with a pocket helical thread disposed on the inner wall surface the pocket such that rotation of the actuator rotates the setting mechanism to move the slip downward. Still another feature of the liner hanger is that the setting mechanism may comprise a piston slidingly engaged within a chamber of the pocket and a passage leading from the housing bore to the chamber, and the actuator comprises a port disposed through a side wall of the actuator, the port being alignable and sealed to the passage when the actuator is within the housing bore such that fluid pressure transmitted through the liner and port applies pressure to the piston to move the slip downward. A further feature of the liner hanger is that the setting mechanism may comprise a piston located within a chamber in the pocket, the chamber on an upper side of the piston being greater than on a lower side of the piston and a detent for releasably retaining the piston in an initial position, and the actuator comprises a device for releasing the detent so that the piston moves downward to push the slip downward and inward. Another feature of the liner hanger is that the actuator may comprise a transmitter and the setting mechanism comprises a fixed inner collar and an axially slidable outer collar, the outer collar being held in a run-in position by a detent assembly, the detent assembly being actuatable by the transmitter to release the outer collar to move downward to a set-position. An additional feature of the liner hanger is that the actuator may comprise a transmitter and the setting mechanism comprises a fixed outer collar and an axially slidable inner collar, the inner collar being held in a run-in position by a detent assembly, the detent assembly being actuatable by the transmitter to release the inner collar to move downward to a set-position.

In another aspect of the disclosure, one or more of the foregoing advantages also may be achieved through a well comprising a string of casing cemented in the well; a housing secured in the string of casing, the housing having an annular pocket of greater inner diameter than an inner diameter of the string of casing, the pocket having a lower tapered end; a slip assembly carried in the pocket, the slip assembly having an initial position defining an inner diameter at least equal to the inner diameter of the casing, the slip assembly having an inner gripping surface; a setting mechanism mounted in the pocket to the slip assembly, the setting mechanism retaining the slip assembly in the initial position; a liner lowered into the casing; and an actuator secured in the liner, the actuator cooperating with the setting mechanism to cause the setting mechanism to move the slip assembly to a lower position on the tapered lower end with the inner gripping surface engaging the liner.

A further feature of the well is that the setting mechanism may comprise at least one recess and the actuator comprises at least one outwardly biased key that enters the recess so that downward movement of the actuator moves the slip downward. Another feature of the well is that the setting mechanism may comprise a helical thread disposed on an outer wall surface, the helical thread being matingly engaged with a pocket helical thread disposed on the inner wall surface the pocket such that rotation of the actuator rotates the setting mechanism to move the slip downward. An additional feature of the well is that the setting mechanism may comprise a piston slidingly engaged within a chamber of the pocket and a passage leading from a housing bore to the chamber, and the actuator comprises a port disposed through a side wall of the actuator, the port being alignable and sealed to the passage when the actuator is within the housing bore such that fluid pressure transmitted through the liner and port applies pressure to the piston to move the slip downward. Still another feature of the well is that the actuator may comprise a transmitter and the setting mechanism comprises a fixed inner collar and an axially slidable outer collar, the outer collar being held in a run-in position by a detent assembly, the detent assembly being actuatable by the transmitter to release the outer collar to move downward to a set-position. A further feature of the well is that the actuator may comprise a transmitter and the setting mechanism comprises a fixed outer collar and an axially slidable inner collar, the inner collar being held in a run-in position by a detent assembly, the detent assembly being actuatable by the transmitter to release the inner collar to move downward to a set-position.

In still another aspect of the disclosure, one or more of the foregoing advantages may be achieved through a method of securing a liner within a bore of a casing string disposed in a wellbore. The method may comprise the steps of: (a) disposing within a wellbore at least two sections of casing secured together by a casing coupler to form the casing string, the casing coupler comprising a housing having a pocket disposed on an inner wall surface of the housing, the pocket having at least one slip, and a setting mechanism operatively associated with the slip; (b) lowering a liner into the bore of the casing string, the liner having an actuator mounted thereon; (c) positioning the actuator in the casing coupler and actuating the setting mechanism by the actuator; (d) with the setting mechanism, moving the slip downward and inward from the pocket until the slip engages an outer wall surface of the liner and, thus, secures the liner within the casing string of the wellbore.

A further feature of the method is that step (c) may be performed by matingly engaging at least one key disposed on the actuator within at least one recess disposed on the setting mechanism and moving the liner down the bore of the casing string. Another feature of the method is that, in step (c), the liner may be rotated while moving down the bore of the casing string. An additional feature of the method is that step (c) may be performed by moving downward a piston of the setting mechanism by pumping fluid down a liner bore of the liner, through a port in the actuator, and through a passage in the setting mechanism so that fluid moves the piston in a downward direction. Still another feature of the method is that step (c) may be performed by transmitting a signal from a transmitter disposed on the actuator to a detent disposed on the setting mechanism, the detent releasing the setting mechanism to move downward upon receiving the signal from the transmitter, the setting mechanism being biased downward.

Figure 1:
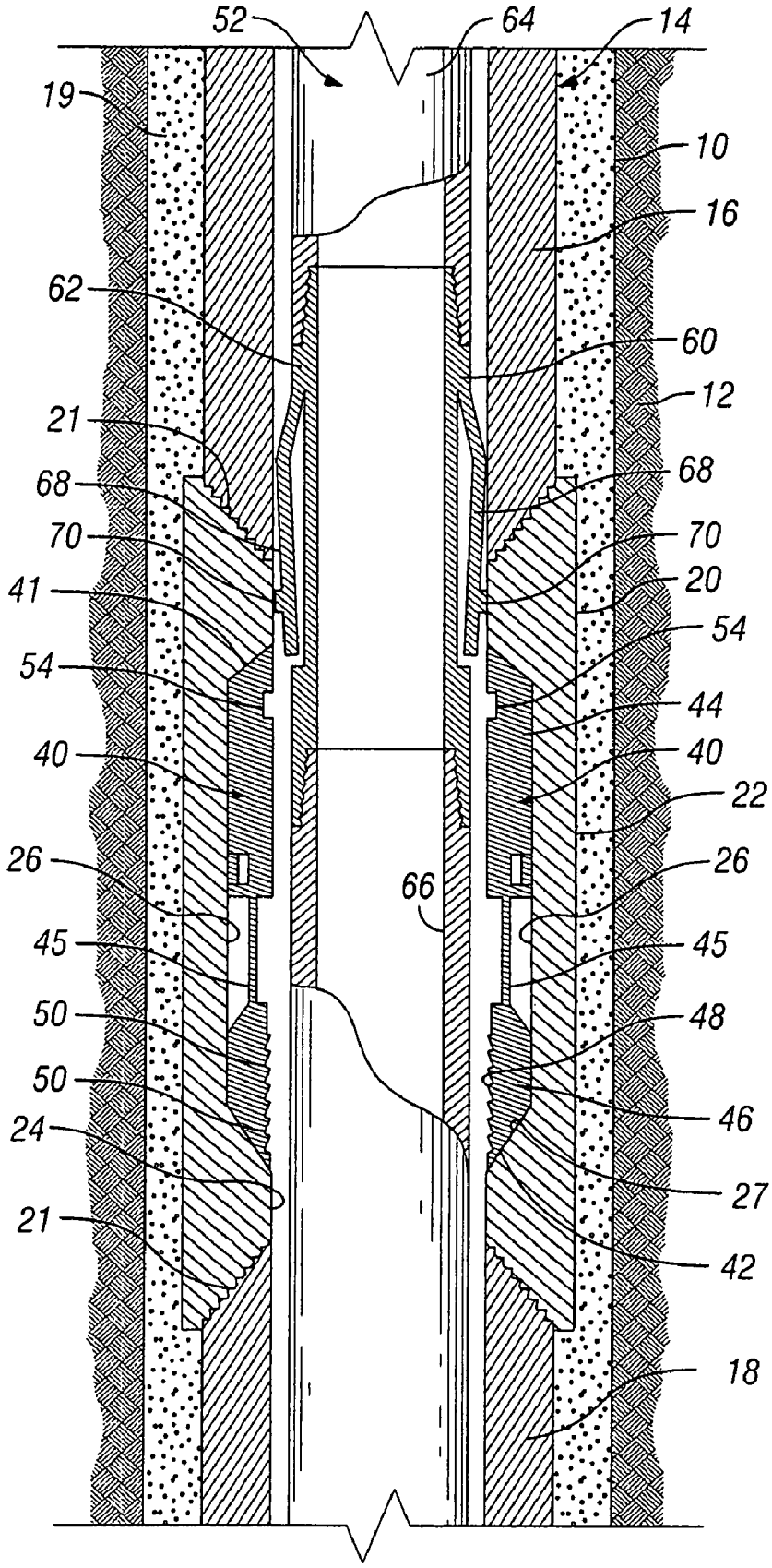
FIG. 1 is a partial cross sectional view of wellbore casing showing one specific embodiment of the coupler of the present invention during run-in of a liner.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

Referring now to FIGS. 1-8, the invention is described broadly with respect to wellbore 10 disposed within formation 12 having casing string or casing 14 disposed therein. Casing string 14 includes upper casing section 16 and lower casing section 18. Upper casing section 16 is supported at its upper end, either directly or indirectly though another piece of casing, by a wellhead assembly. Collar or coupler 20 connects upper casing section 16 with lower casing section 18 using any method or device known to persons of ordinary skill in the art, such as by threads 21. Casing string 14 and coupler 20 are secured within formation 12 by cement 19. Upper casing section 16 and lower casing section 18 have the same inner and outer diameters.

Coupler 20 includes an outer wall surface 22 defining an outer diameter and an inner wall surface 24. Inner wall surface 24 includes recess or pocket 26 defined by an enlarged inner diameter between two smaller inner diameters—one above and one below. Shoulder 27 of pocket 26 is conical.

Slip 40 is disposed within pocket 26. Slip 40 includes first end 41 and second end 42. Slip first end 41 includes setting mechanism 44 and slip second end 42 includes gripping member 46 having slip gripping profile 48 for engaging or biting into liner 52 being hung within wellbore 10. Setting mechanism 44 may be a single solid sleeve, a single partial sleeve, or a plurality of partial sleeves separated by vertical slots and disposed circumferentially around pocket 26.

Gripping member 46 is connected to setting mechanism 44 by connection member 45. The lower ends of gripping members 46 are tapered to mate with shoulder 27. Connection member 45 is a flexible or collapsible thin walled portion of slip 40 whose flexibility or collapsibility facilitates setting of slip 40. Connection member 45 may be a single thin walled sleeve, a single partial thin walled sleeve, or a plurality of thin walled strips or partial sleeves separated by vertical slots so that each setting mechanism 44 is connected to a different gripping member 46.

Gripping profile 48 may have wickers or any other configuration that facilitates gripping profile 48 to grip or bite into liner 52 being hung within casing 14. For example, gripping profile 48 may include teeth 50. Alternatively, gripping profile 48 may be profiled with grippers formed of carbide or other material, velcro material, ball bearings, or spray-on grit surfaces, or any other material that facilitates increased friction or provides surface penetration of the gripping profile 48 into liner 52. In a preferred embodiment, gripping profile 48 is curved or concave, having the same curvature as the outer diameter of liner 52. In one specific embodiment, gripping profile 48 is a cam surface causing a camming motion against liner 52 to facilitate securing liner 52 to wellbore casing 14.

Figure 2A:
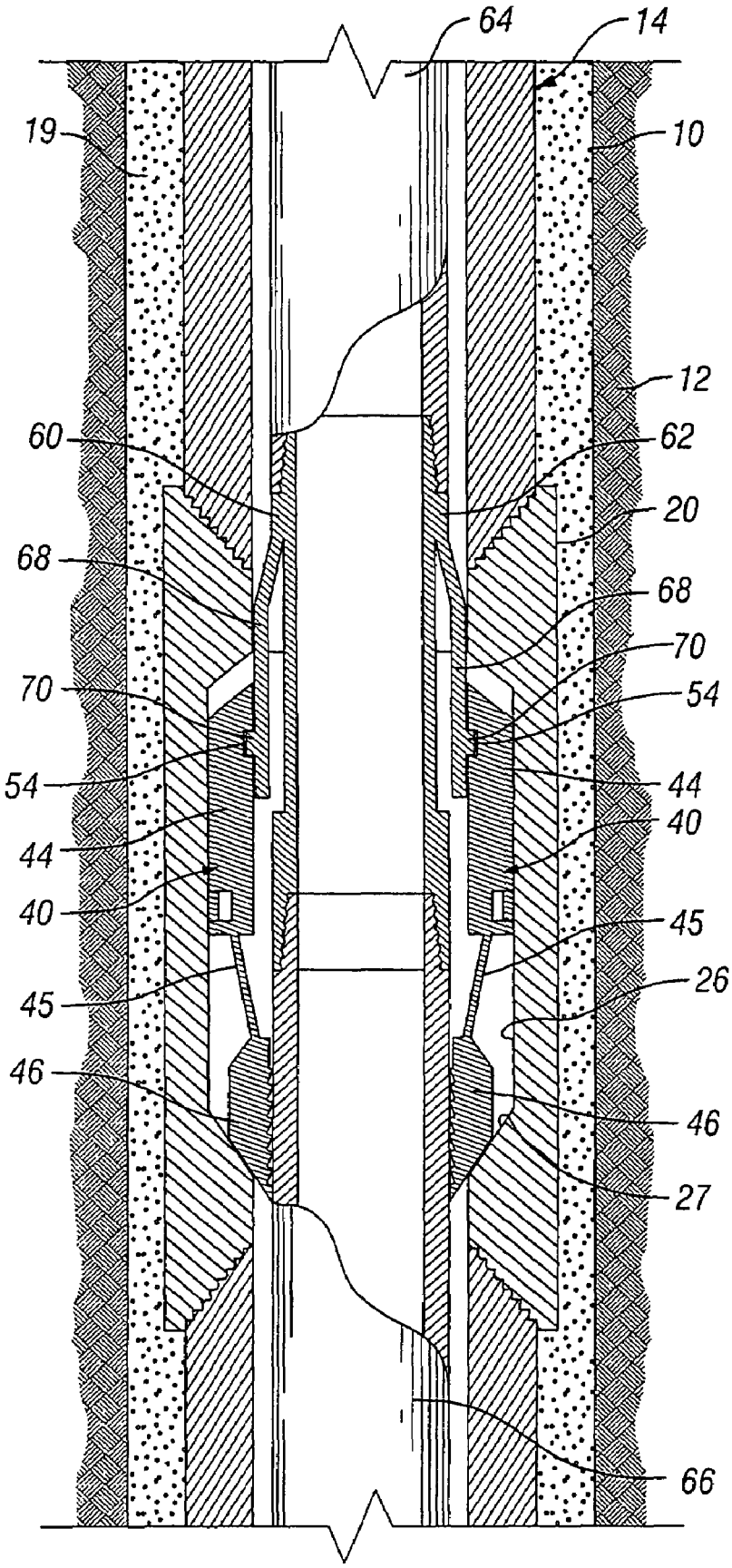
FIG. 2A is a partial cross-sectional view of the wellbore casing of FIG. 1 showing the coupler of FIG. 1 in the set position.
Figure 2B:
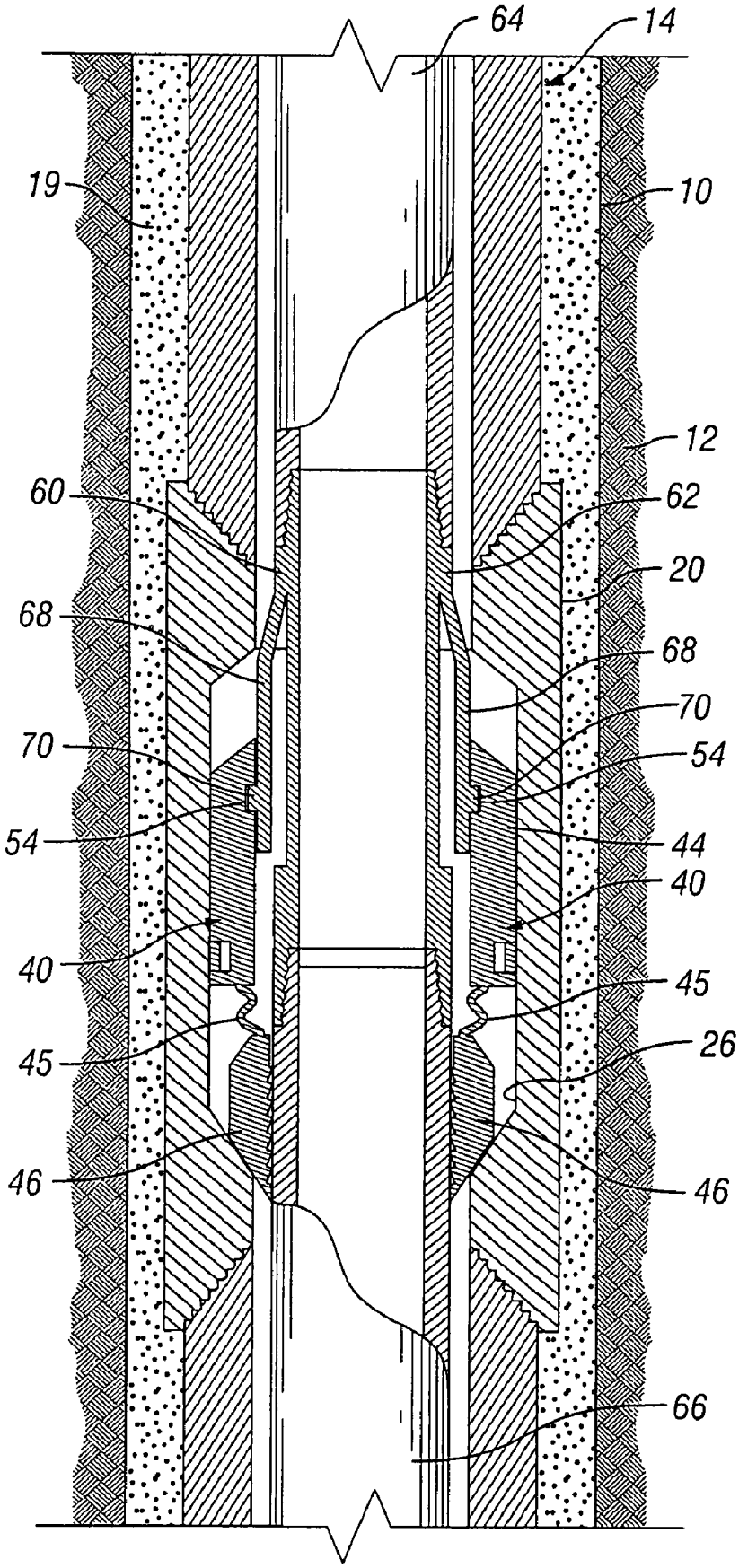
FIG. 2B is a partial cross-sectional view of the wellbore casing of FIG. 1 showing an alternative embodiment of the coupler of FIG. 1 in the set position.

Referring now to FIGS. 1-2B, in one specific embodiment, setting mechanism 44 comprises one or more recesses 54 disposed circumferentially around the inner diameter of slip 40. It is to be understood that the term recess 54 includes a single continuous groove uninterruptedly disposed around the inner diameter of slip 40 as well as one or more slots interruptedly disposed around the inner diameter of slip 40.

Recess 54 is engaged by an actuator, which in this embodiment is collet 60 disposed on sub 62, which is secured to two sections 64, 66 of liner 52. Alternatively, collect 60 may be secured directly to the outer diameter of a piece of liner such as through welding.

Collet 60 includes one or more outwardly biased fingers 68, each finger 68 having key or tab 70 for engagement within recess 54 of setting mechanism 44. Each finger 68 is forced inward by the inner wall surface of casing 14 during run-in of liner 52. When finger 68 is disposed opposite recess 54 by moving liner 52 downward within casing 14, the outwardly biased fingers 68 move outward so that keys 70 of fingers 68 are inserted into recess 54. After engagement of keys 70 into recess 54, further downward movement of liner 52 causes slip 40 to move downward. In so doing, gripping member 46 is forced radially outward from pocket 26 and into the outer wall surface of liner 52. Gripping profile 48 engages, bites, or cams into the outer wall surface of liner 52, resulting in liner 52 being secured within casing 14 as shown in FIGS. 2A and 2B. In the embodiment shown in FIG. 2A, connection member 45 flexes to facilitate gripping member 46 being moved radially outward. In an alternative embodiment, shown in FIG. 2B, connection member 45 collapses into an "S" shape to facilitate gripping member 46 being moved radially outward. The weight of liner 52 maintains slips 40 in the set position. It is noted, however, that upon lifting the liner upward, the weight acting downward on slip 40 is decreased such that liner 52 may be lifted. Alternatively, liner 52, once set, could be cemented in place. Liner 52 may be run in on a running string that is retrieved from liner 52. A seal (not shown) may be installed between liner 52 and casing 14.

It is also noted that collet may be designed in such a way as to release slip 40 so that liner 52 can be removed from casing string 14. For example, one or more explosive charges (not shown) may be disposed along each finger 68 of collect 60. Denotation of these charges will cause each finger 68 to break away from liner 52, thereby releasing liner 52 from slip 40.

Initially, slip 40 is fully recessed within pocket 26. Because the components of slip 40 are retained within pocket 26 of casing coupler 20, the gap between the exterior of liner 52 and the interior of casing string 14 can be quite small. For example, in a casing string made up of 35.3 lb., casing sections with an external diameter of 5 inches, an interior diameter of 4.126 inches would be available. Thus, it would be possible to insert liner 52 having a diameter approximating 4 inches, rather than a smaller diameter liner such as one having a diameter of 2-⅞ inches. As mentioned above, the use of a larger diameter liner 52 is desirable for two reasons. First, the resulting available cross-sectional flow and work bore area of liner 52 will be larger. Second, gripping member 46 of slip 40 can be more easily and securely held against the larger diameter liner 52.

Figure 3:
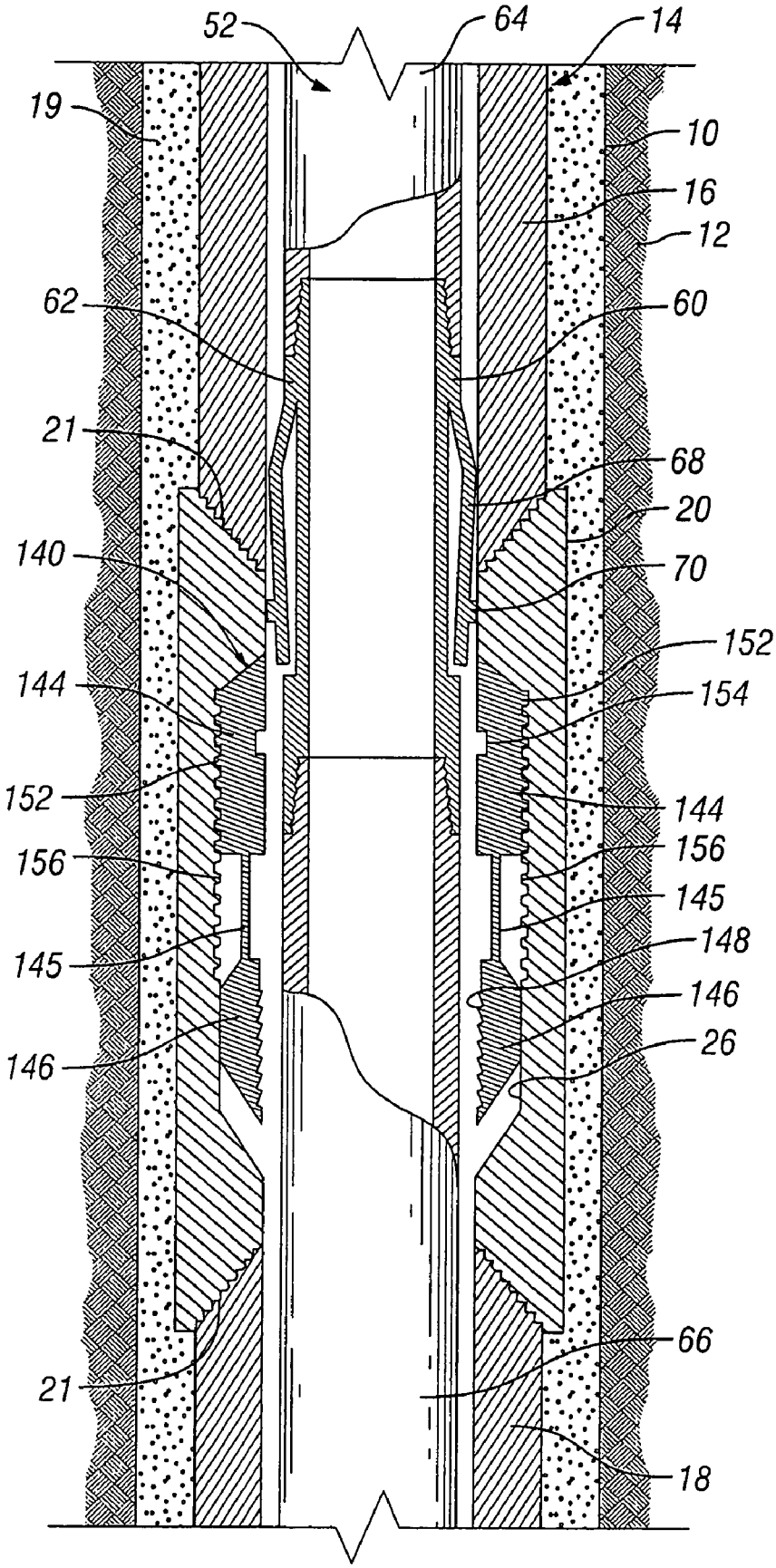
FIG. 3 is a partial cross sectional view of wellbore casing showing another specific embodiment of the coupler of the present invention during run-in of a liner.
Figure 4:
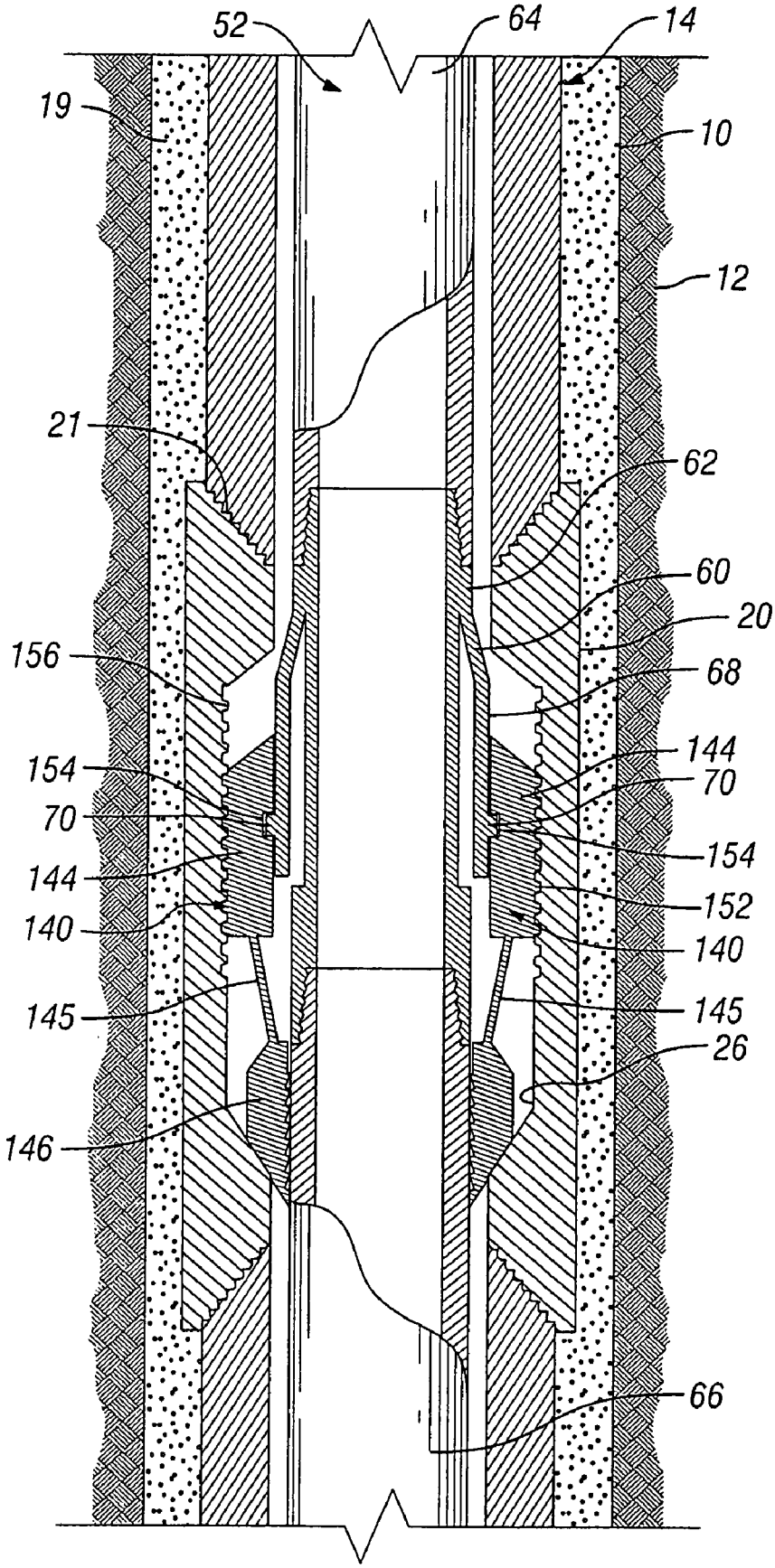
FIG. 4 is a partial cross-sectional view of the wellbore casing of FIG. 3 showing the coupler of FIG. 3 in the set position.

Referring now to FIGS. 3-4, in another embodiment, slip 140 includes setting mechanism 144 having an outer wall surface 150 with external helical threads 152. Internal helical threads 156 are formed on the interior of pocket 26 for receiving external helical threads 152. Thus, external and internal threads 152, 156 are inter-engaged with one another in a well-known manner such that rotation of slip 140 within casing coupler 20 will move slip 140 axially within coupler 20. One or more slots 154 is located on the radial inner wall surface of slip 140 for facilitating rotation of slip 140 as discussed in greater detail below.

In FIG. 3, slip 140 is in an unset, initial position. In FIG. 4, liner 52 has been inserted into casing string 14. Sub 62 having collet 60 is disposed between sections 64, 66 of liner 52 in the same manner as discussed in greater detail above with respect to FIGS. 1-2B. In an alternative embodiment, collet 60 is connected directly to the outer wall surface of liner 52 such as by welding. Collect 60 includes one or more radially extending keys 70 that are shaped and sized to fit within their corresponding slots 154 in the same manner as the embodiment mentioned above with respect to FIGS. 1-2B. Like the embodiments in FIGS. 1-2B, keys 70 are preferably spring-biased radially outwardly from the body of collet 60 so that they may be compressed radially inwardly as needed for disposal down through casing string 14 and to extend radially outward upon encountering slots 154. When keys 70 are located within their corresponding slots 154, slip 140 is secured rotationally with respect to collect 60 and, thus, sub 62 and liner 52. As a result, rotating liner 52 from the surface of the well causes sub 62 and, thus, collet 60 and slip 140, to rotate. In order to set gripping member 146 into liner 52, liner 52 is rotated at the surface to cause slip 140 to move axially downward with respect to casing coupler 20, thereby radially forcing gripping member 146 outward and causing gripping member 146 to engage, bite, or cam into the outer radial surface of liner 52. As with the embodiment shown in FIGS. 1-2B, the inward compressive force exerted by gripping member 146 upon the outer wall surface of liner 52 is sufficient to prevent counter-rotation of liner 52 within casing string 14 that might cause slip 140 to become unset.

As with the embodiment shown in FIGS. 1-2B, connection member 145 may flex during setting of slip 140 as shown in FIG. 2A or connection member 145 may collapse during setting of slip 140 as shown in FIG. 2B.

Figure 5:
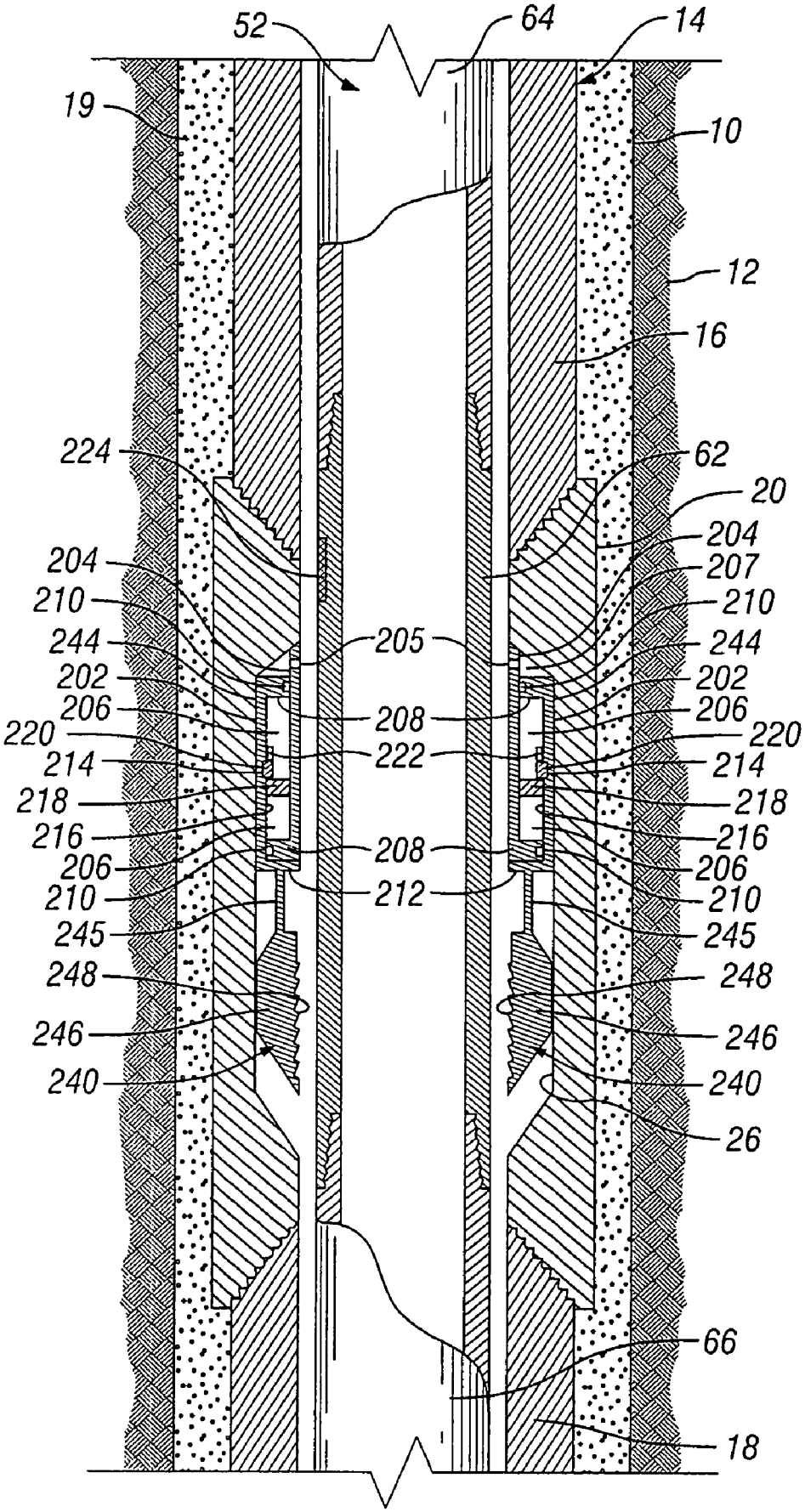
FIG. 5 is a partial cross sectional view of wellbore casing showing an additional specific embodiment of the coupler of the present invention during run-in of a liner.
Figure 6:
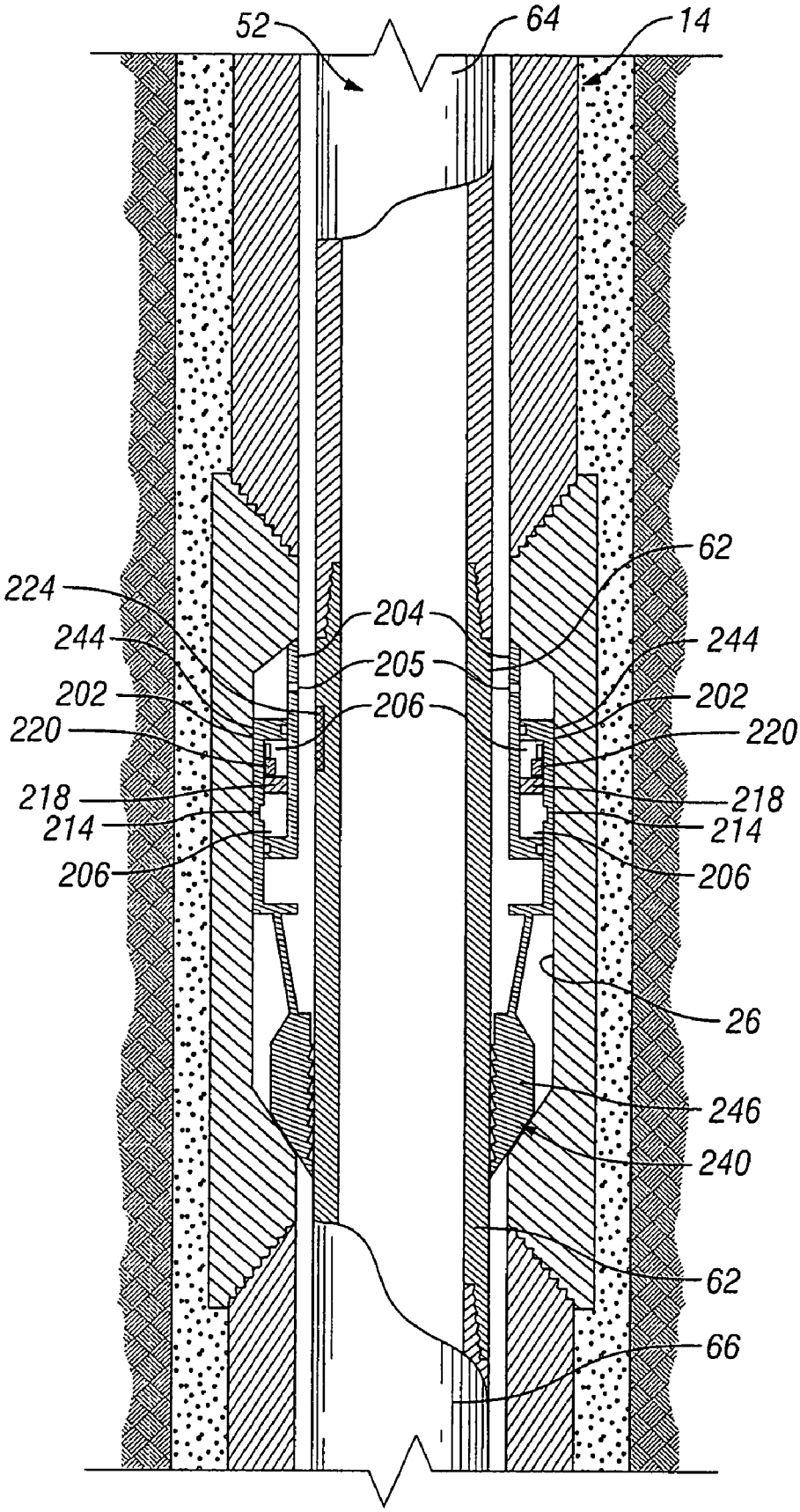
FIG. 6 is a partial cross-sectional view of the wellbore casing of FIG. 5 showing the coupler of FIG. 5 in the set position.

Referring now to FIGS. 5-6, in another specific embodiment, slip 240 includes setting mechanism 244 that comprises an energy source that is contained within casing string 14 prior to disposing liner 52 into casing string 14. Pocket 26 of casing coupler 20 contains outer collar 202 and inner collar 204. Inner collar 204 is disposed radially within outer collar 202 and chamber 206 is defined radially between collars 202, 204. Flanged end portions 208 and seals 210 are provided for each of collars 202, 204. Inner collar 204 includes port 205 that provides fluid communication between the wellbore of casing string 14 and chamber 207. Thus, chamber 207 is under wellbore or hydrostatic pressure.

Outer collar 202 includes lower axial end portion 212 that is connected to connection member 245, which is connected to gripping member 246. Recess 214 is inscribed within the interior radial surface 216 of outer collar 202. Stop ring 218 is fixedly secured to inner collar 204 and is, in turn, secured to a split ring, or C-ring member 220. Although stop ring 218 is shown in FIGS. 5-6 as being in contact with outer collar 202, it is to be understood that a gap may be between stop ring 218 and outer collar 202; provided that stop ring 218 continues to contact split ring 220.

In the unset position (FIG. 5), split ring 220 resides within recess 214 of outer collar 202. Split ring actuator 222 is operably interconnected with split ring 220. Split ring actuator 222 preferably comprises a programmable electronic transceiver that is designed to receive a triggering signal from a transmitter. Signal transmitter 224 is incorporated within liner 52. In one currently preferred embodiment, signal transmitter 224 may comprise a RFID (radio frequency identification) tag or chip which is designed to emit a triggering signal upon passing within a certain proximate distance of actuator 222. Actuator 222 is operably associated with split ring 220 to retract split ring 220 radially inwardly and out of recess 214 upon receipt of the signal from transmitter 224. Radial retraction of split ring 220 may be done by the actuator mechanically, magnetically, or using other suitable known techniques.

Chamber 206 is at a lower pressure, e.g., atmospheric pressure, as compared to the hydrostatic pressure in chamber 207 so that there is a pressure differential across flanged end portion 208 of outer collar 202 and, thus, lower axial end portion 212. The pressure differential urges flanged end portion 208 of outer collar 202 and, thus, lower axial end portion 212 of outer collar 202, downward toward the set position (FIG. 6). In variations on this embodiment, one or both of chamber 206 or chamber 207 could be replaced with a mechanical spring to serve as an energy source to bias outer collar 202 downward. Additionally, transmitter 224 and actuator 222 could be replaced by a mechanical trigger arrangement wherein the spring is mechanically released from a compressed state by engaging a release latch for the spring with an engagement member within liner 52. Further a combustible material, gas-generating material, or other pressure generating or boosting device or mechanism may also be disposed within chamber 206 or chamber 207 to assist in the downward movement of outer collar 202.

In operation, slip 240 is in the initially unset position shown in FIG. 5. Liner 52 is lowered into casing string 14 until transmitter 224 is located proximate actuator 222. The triggering signal is received by actuator 222, which then releases split ring 220 from recess 214. If desired, a delay could be incorporated into the programming of actuator 222 such that a predetermined period of time elapses between the time the triggering signal is received by actuator 222 and split ring 220 is released from recess 214. When split ring 220 is released from recess 214, hydrostatic pressure within the chamber 207 will urge outer collar 202 axially downward so that lower axial end portion 212 moves gripping member 246 downward and, thus radially inward so that gripping profile 248 engages, bites, or cams into liner 52 as shown in FIG. 6, thereby securing liner 52 within casing string 14. As with the previously discussed embodiments shown in FIGS. 1-4, connection member 245 may flex during setting of slip 240 as shown in FIG. 2A or connection member 245 may collapse during setting of slip 240 as shown in FIG. 2B.

Figure 7:
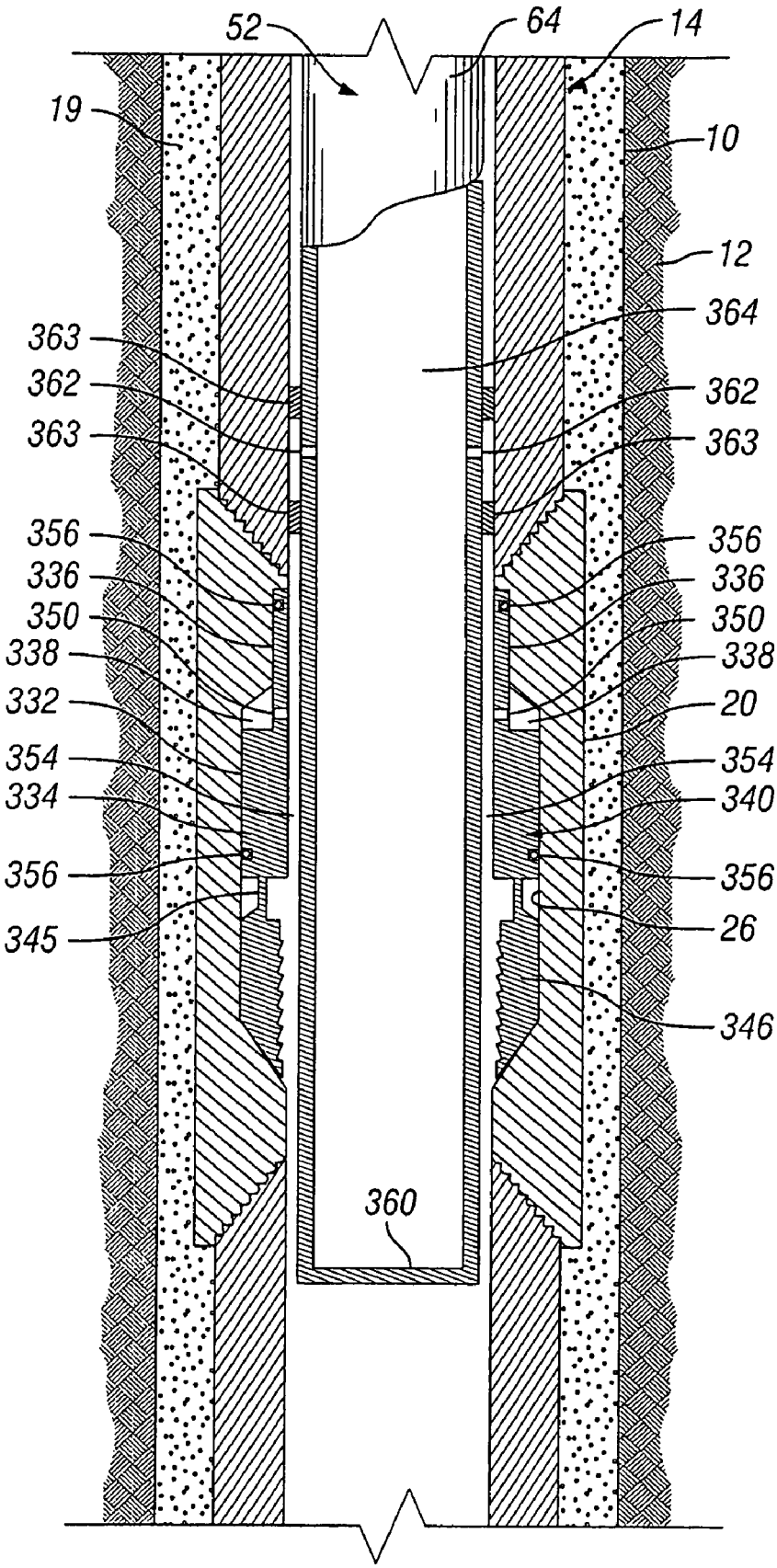
FIG. 7 is a partial cross sectional view of wellbore casing showing a further specific embodiment of the coupler of the present invention during run-in of a liner.
Figure 8:
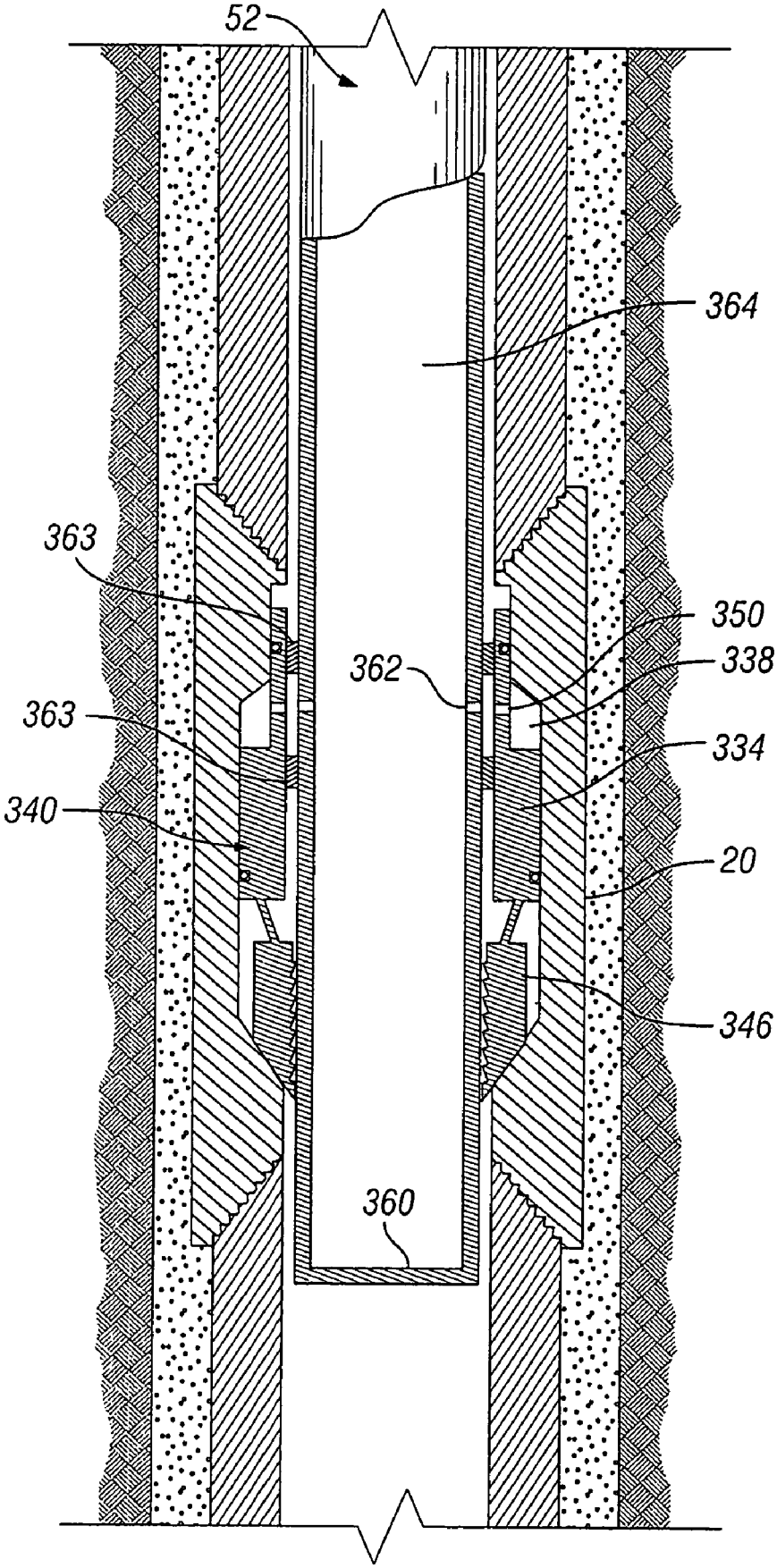
FIG. 8 is a partial cross-sectional view of the wellbore casing of FIG. 7 showing the coupler of FIG. 7 in the set position.

Referring now to FIGS. 7-8, in another specific embodiment, slip 340 utilizes hydraulic setting via liner 52. Gripping member 346 is retained within pocket 26 along with setting piston 332. Setting piston 332 features an enlarged compression head portion 334 that is connected to connection member 345 which is connected to gripping member 346. Piston head portion 334 is also connected to a reduced diameter stem portion 336 that extends upwardly from piston head portion 334.

Fluid chamber 338 is defined between setting piston 332 and the casing string 14 within pocket 26. Fluid flow ports 350 are disposed through setting piston 332 to permit fluid communication between fluid chamber 338 and the interior flowbore 354 of setting piston 332. Fluid seals 356 are provided between setting piston 332 and casing coupler 20 to ensure fluid tightness of fluid chamber 338.

The lower end of liner 52 is closed off by plug 360. Plug 360 is preferably a temporary or removable plug which can be removed, such as by milling, to allow flow through liner 52 at a later point during production operations. Ports 362 are disposed through the side of liner 52 and seals 363 are disposed above and below each port 362 along the outer diameter of liner 52. As shown in FIGS. 7-8, seals 363 slide along the inner diameter of casing 14. It is to be understood, however, that casing 14 may have a slightly larger inner diameter so that seals 363 do not slide along the inner diameter of casing 14.

In operation, slip 340 is initially in the unset position (FIG. 7). Liner 52 is then disposed into casing string 14 until ports 362 of liner 52 are generally aligned with fluid flow ports 350 in setting piston 332. The interior flowbore 364 of liner 52 is then pressurized so that fluid is flowed through the aligned ports 350 and 362 and into fluid chamber 338. Seals 363 isolate the bore of casing 14 from the higher pressure. Setting piston 332 is urged downward by the fluid pressure so that the enlarged piston head portion 334 forces gripping member 346 inwardly so that gripping profile 348 engages, bites, or cams, into the outer wall surface of liner 52 (FIG. 8). As with the previously discussed embodiments shown in FIGS. 1-6, connection member 345 may flex during setting of slip 340 as shown in FIG. 2A or connection member 345 may collapse during setting of slip 340 as shown in FIG. 2B.

Once secured within coupler 20, liner plug 360 can be drilled or milled away so that liner 52 can be use in production or other desired operations.

It is to be understood that the invention is not limited to the exact details of construction, operation, exact materials, or embodiments shown and described, as modifications and equivalents will be apparent to one skilled in the art. For example, a ratchet mechanism may be located at the lower end of stem portion 336 to operate in the manner of a body lock ring to ensure one-way sequential movement of the setting piston 332 with respect to the surrounding casing coupler 20. Such a ratchet mechanism may also be utilized with any of the other embodiments so that liner 52 cannot be removed from the slips by upward movement alone. Additionally, the coupler may have only one slip or a plurality of slips having a space between each slip. Moreover, the recess within the setting mechanism may be a single continuous groove along the inner wall surface of the slip or it may be one or more short slots. Further, the slip may be a single sleeve component having one or more gripping members. Additionally, in the embodiment in which liner 52 includes one or more port 362, seals 363 may be disposed on setting piston 332 instead of on liner 52. Moreover, the embodiment shown in FIGS. 5-6 could be reconfigured such that outer collar 202 is fixed in place and inner collar 204 is permitted to move downward. Further, actuator 222 and split ring 220 may be disposed on inner collar 204 and in contact with flanged end portion 208 of outer collar 202. In addition, transmitter 224 may not be located on the liner, but instead transmitter 224 may be located elsewhere, such as on the casing string, in the coupler, or as part of the setting mechanism. In such an embodiment, transmitter 224 is activated from the surface of the wellbore after the liner is placed in its desired position within the casing. Accordingly, the invention is therefore to be limited only by the scope of the appended claims.

What is claimed is:

1. A liner hanger for hanging a liner within a bore of a casing string, the liner hanger comprising:

a housing for securing into the casing string at a desired location, the housing having a housing bore, an outer wall surface, and an inner wall surface, the inner wall surface having a pocket disposed thereon;

a slip disposed within the pocket, the slip having a gripping inner wall surface;

an actuator for connection to the liner for placement within the housing bore, the actuator when in the housing bore, causing the slip to move downward and inward to engage and secure the liner within the bore; and a setting mechanism mounted to the slip, the slip being movable from an upper position fully recessed within the pocket to a lower position wherein the gripping inner surface protrudes inward from the pocket, the actuator comprising a transmitter and the setting mechanism comprising a detent assembly, the detent assembly being actuatable by the transmitter to release the setting mechanism to move downward to a set-position.

2. The liner hanger of claim 1, wherein the slip is attached to the setting mechanism by a flexible connection member.

3. The liner hanger of claim 1, wherein the slip is attached to the setting mechanism by a collapsible connection member.

4. The liner hanger of claim 1, wherein the setting mechanism comprises an inner diameter that is equal to an inner diameter of the casing string.

5. The liner hanger of claim 1, wherein the detent assembly comprises a fixed inner collar and an axially slidable outer collar, the outer collar being held in a run-in position until actuated by the transmitter.

6. The liner hanger of claim 1, wherein the detent assembly comprises a fixed outer collar and an axially slidable inner collar, the inner collar being held in a run-in position until actuated by the transmitter.

7. The liner hanger of claim 1, wherein the setting mechanism further comprises a piston located within a chamber in the pocket, the chamber on an upper side of the piston being greater than on a lower side of the piston, and the detent assembly releasably retaining the piston in an initial position until the transmitter releases the piston so that the piston moves downward to push the slip downward and inward.

8. A well comprising:

a string of casing cemented in the well;

a housing secured in the string of casing, the housing having an annular pocket of greater inner diameter than an inner diameter of the string of casing, the pocket having a lower tapered end;

a slip assembly carried in the pocket, the slip assembly having an initial position defining an inner diameter at least equal to the inner diameter of the casing, the slip assembly having an inner gripping surface;

a liner lowered into the casing;

an actuator secured in the liner, the actuator cooperating with a setting mechanism to cause the setting mechanism to move the slip assembly to a lower position on the tapered lower end with the inner gripping surface engaging the liner, the setting mechanism mounted in the pocket to the slip assembly, the setting mechanism retaining the slip assembly in the initial position, the actuator comprising a transmitter and the setting mechanism comprising a detent assembly, the detent assembly being actuatable by the transmitter to release the setting mechanism to move downward to a set-position.

9. The well of claim 8, wherein the slip is attached to the setting mechanism by a flexible connection member.

10. The well of claim 8, wherein the slip is attached to the setting mechanism by a collapsible connection member.

11. The well of claim 8, wherein the setting mechanism comprises an inner diameter that is equal to an inner diameter of the casing string.

12. The well of claim 8, wherein the detent assembly comprises a fixed inner collar and an axially slidable outer collar, the outer collar being held in a run-in position until actuated by the transmitter.

13. The well of claim 12, wherein the detent assembly comprises a fixed outer collar and an axially slidable inner collar, the inner collar being held in a run-in position until actuated by the transmitter.

14. The well of claim 8, wherein the setting mechanism further comprises a piston located within a chamber in the pocket, the chamber on an upper side of the piston being greater than on a lower side of the piston, and the detent assembly releasably retaining the piston in an initial position until the transmitter releases the piston so that the piston moves downward to push the slip downward and inward.

15. A method of securing a liner within a bore of a casing string disposed in a wellbore, the method comprising the steps of:

(a) disposing within a wellbore at least two sections of casing secured together by a casing coupler to form the casing string, the casing coupler comprising a housing having a pocket disposed on an inner wall surface of the housing, the pocket having at least one slip, and a setting mechanism operatively associated with the slip;

(b) lowering a liner into the bore of the casing string, the liner having an actuator mounted thereon;

(c) positioning the actuator in the casing coupler and actuating the setting mechanism by the actuator by transmitting a signal from a transmitter disposed on the actuator to a detent disposed on the setting mechanism, the detent releasing the setting mechanism to move downward upon receiving the signal from the transmitter, the setting mechanism being biased downward;

(d) with the setting mechanism, moving the slip downward and inward from the pocket until the slip engages an outer wall surface of the liner and, thus, secures the liner within the casing string of the wellbore.

* * * * *